US009493992B2

(12) United States Patent
Stowe, II et al.

(10) Patent No.: US 9,493,992 B2
(45) Date of Patent: Nov. 15, 2016

(54) CUTTING DEVICE AND METHOD OF MAKING

(71) Applicants: Calvin J. Stowe, II, Bellaire, TX (US); Andrew D. Ponder, Houston, TX (US)

(72) Inventors: Calvin J. Stowe, II, Bellaire, TX (US); Andrew D. Ponder, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 523 days.

(21) Appl. No.: 14/027,921

(22) Filed: Sep. 16, 2013

(65) Prior Publication Data

US 2015/0075874 A1 Mar. 19, 2015

(51) Int. Cl.

| | |
|---|---|
| ***E21B 10/46*** | (2006.01) |
| ***E21B 10/58*** | (2006.01) |
| ***E21B 10/48*** | (2006.01) |
| ***E21B 10/54*** | (2006.01) |

(52) U.S. Cl.

CPC ..... *E21B 10/58* (2013.01); *E21B 10/46* (2013.01); *E21B 10/48* (2013.01); *E21B 10/54* (2013.01); *Y10T 29/49826* (2015.01)

(58) Field of Classification Search

USPC ..... 175/403, 426

See application file for complete search history.

(56) References Cited

U.S. PATENT DOCUMENTS

| | | | | |
|---|---|---|---|---|
| 2,549,088 | A * | 4/1951 | Hettelsater | E02F 3/783 172/747 |
| 5,950,747 | A | 9/1999 | Tibbitts et al. | |
| 6,164,394 | A | 12/2000 | Mensa-Wilmot et al. | |
| 2010/0106285 | A1 * | 4/2010 | Massey | B23K 9/16 700/212 |
| 2011/0192653 | A1 | 8/2011 | Stowe, II et al. | |
| 2011/0203856 | A1 | 8/2011 | Lynde et al. | |
| 2011/0315448 | A1 | 12/2011 | Stowe, II et al. | |
| 2012/0132471 | A1 | 5/2012 | Zhang et al. | |
| 2012/0199395 | A1 * | 8/2012 | Lynde | E21B 10/006 175/57 |

OTHER PUBLICATIONS

T.M. Warren, et al., "Drag-Bit Performance Modeling"; Society of Petroleum Engineers; SPE Drilling Engineering, Jun. 1989; pp. 119-127.

Robert Clayton, et al., "New Bit Design, Cutter Technology Extend PDC Applications to Hard Rock Drilling"; SPE/IADC; Conference Paper SPE/IADC 91840; SPE/IADC Drilling Conference, Feb. 23-25, 2005; pp. 1-9.

Notification of Transmittal of the International Search Report and the Written Opinion of the International Searching Authority, or the Declaration; PCT/US2014/051178; mailed Nov. 26, 2014; 9 pages.

* cited by examiner

*Primary Examiner* — Taras P Bemko

(74) *Attorney, Agent, or Firm* — Cantor Colburn LLP

(57) ABSTRACT

A cutting device includes, at least one stack of cutting elements attached to a cutter surface having, a first element and a second element attached to the cutter surface. A third element is attached to the first element and the second element. The three elements are sized and shaped such that prior to attachment to the cutter surface the three elements are restable in a stable manner on the cutter surface due to gravity alone. A plane-defined-surface defined by one of the two planes of a modified gilmoid of the third element positioned further from the cutter surface is oriented at an angle of about 35 to 55 degrees relative to the cutter surface.

29 Claims, 4 Drawing Sheets

CUTTING DEVICE AND METHOD OF MAKING

BACKGROUND

Cutting tools, such as mills used in downhole applications, for example, can be made with a plurality of cutting elements that are adhered to a surface of a tool. The cutting elements can be randomly shaped particles made by fracturing larger pieces. Alternately, cutting elements can be precisely formed into repeatable shapes using processes such as machining and molding, for example. Regardless of the process employed to make the individual cutting elements the elements are typically adhered to the mill with random orientations. These random orientations create disparities in maximum heights relative to a surface of the mill. Additionally, large disparities may exist between the heights of the portions of the cutting elements that engage the target material during a cutting operation. Furthermore, angles of cutting surfaces relative to the target material are randomized and consequently few are near preferred angles that facilitate efficient cutting. Apparatuses and methods to lessen the foregoing drawbacks would therefore be well received in the industry

BRIEF DESCRIPTION

Disclosed herein is a method of making a cutting device. The method includes, positioning a first element and a second element on a cutter surface, stacking a third element onto the first element and the second element, the third element has a modified gilmoid with a support protruding from at least one of two plane-defined-surfaces that define the modified gilmoid, such that the one of two plane-defined-surfaces of the modified gilmoid further from the cutter surface forms an angle of between about 35 and 55 degrees with the cutter surface, attaching the third element to the first element and the second element, and attaching the first element and the second element to the cutter surface.

Further disclosed herein is a cutting device. The device includes, at least one stack of cutting elements attached to a cutter surface having, a first element and a second element attached to the cutter surface, and a third element attached to the first element and the second element, the three elements being sized and shaped such that prior to attachment to the cutter surface the three elements are restable in a stable manner on the cutter surface due to gravity alone such that a plane-defined-surface defined by one of the two planes of a modified gilmoid of the third element positioned further from the cutter surface is oriented at an angle of about 35 to 55 degrees relative to the cutter surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
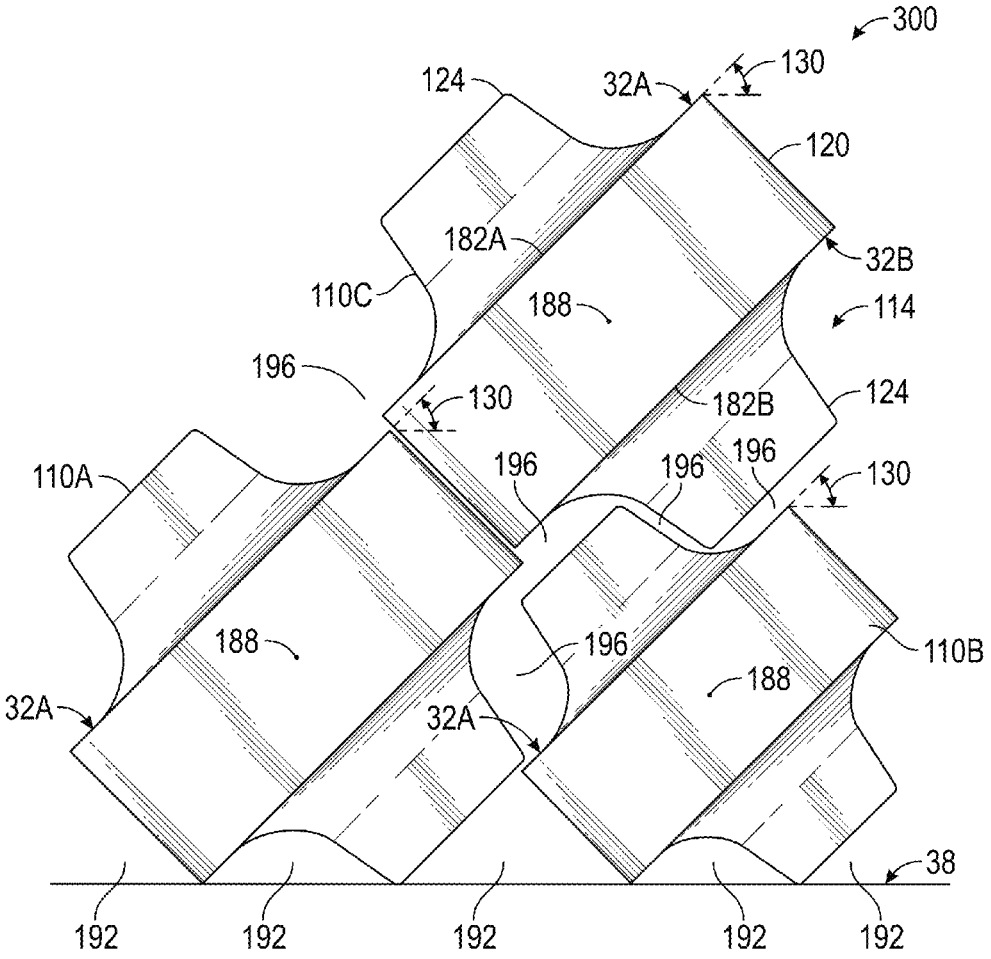
FIG. 1 depicts a side elevation view of a portion of a cutting device disclosed herein.
Figure 2:
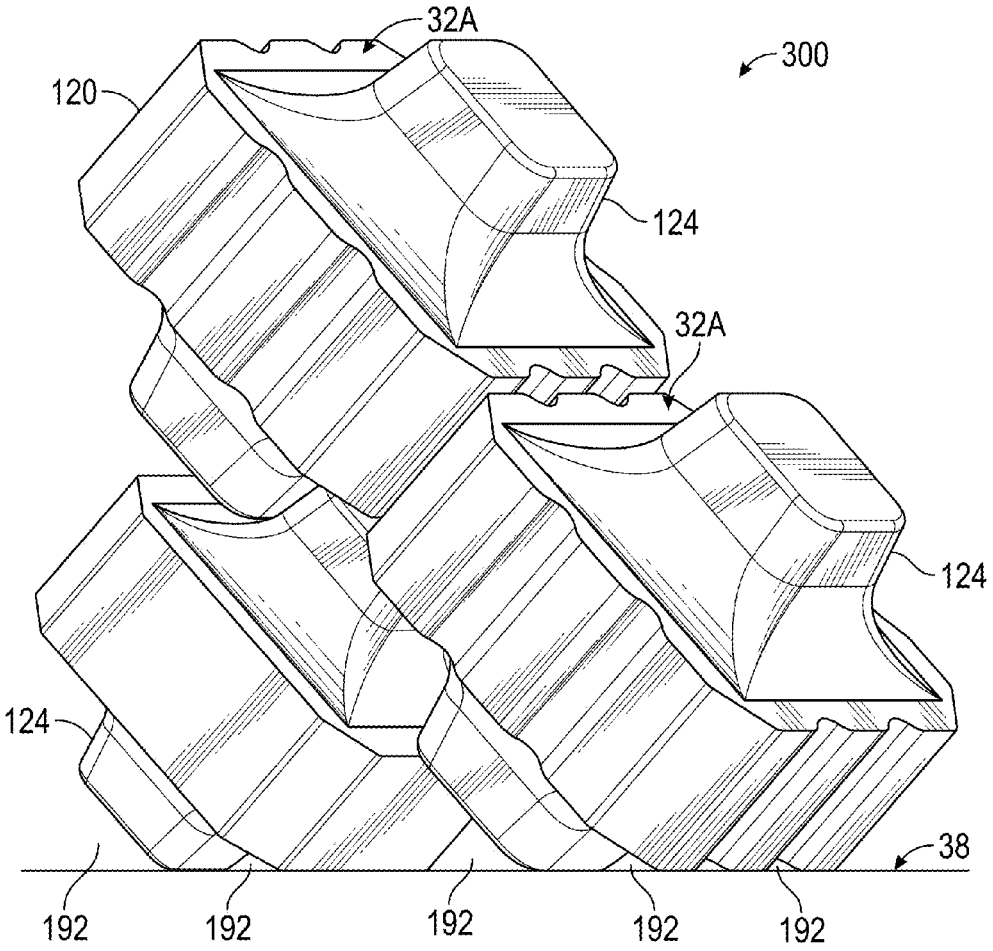
FIG. 2 depicts a perspective view of the portion of the cutting device of FIG. 1.

Referring to FIGS. 1 and 2, an embodiment of a cutting device 300 illustrated herein has a plurality of cutting elements 110A, 110B, 110C, with three being shown attached to a cutter surface 38 of the cutting device 300. The cutting elements 110A, 110B, 110C meet all the specific characteristics of the cutting element 110 disclosed in copending U.S. patent application Ser. No. 13/492,267 filed Jun. 8, 2012, assigned to the same assignee, the entire contents of which are included herein by reference. As such, all the details that define the cutting elements 110A, 110B, 110C, are not described again hereunder although the same reference characters will be employed between the reference application and this application to aid understanding and minimize confusion. Each of the cutting elements 110A, 110B, 110C include a central portion 120 defined as a modified gilmoid. The modified gilmoid 120 is defined in part by two planes 182A and 182B that define plane-defined-surfaces 32A and 32B respectively. The cutting elements 110A, 110B, 110C further includes supports 124 that extend from one or both of the plane-defined-surfaces 32A, 32B. For cutting elements 110A, 110B, 110C that include two of the supports 124 it should be noted that the two supports 124 may or may not be symmetrical to one another. However, in the embodiment illustrated the two supports 124 on each of the cutting elements 110A, 110B, 110C are symmetrical.

The three cutting elements 110A, 110B, 110C in the embodiment of FIGS. 1 and 2 of the cutting device 300, form a stack 114 on the cutter surface 38 and are attached to the cutter surface 38 and to one another. More specifically the first element 110A and the second element 110B are attached to the cutter surface 38 directly while the third element 110C is attached to the first element 110A and the second element 110B. The three elements 110A, 110B, 110C are sized and shaped, so they can be positioned to rest in a stable manner on the cutter surface 38 due to the force of gravity alone such that the plane-defined-surface 32A of at least the third element 110C that is further from the cutter surface 38 than the plane-defined-surface 32B forms an angle 130 of about 45 degrees, or within a range of between about 35 to 55 degrees with the cutter surface 38.

Although not required, in the embodiment illustrated all three of the cutting elements 110A, 110B, and 110C have the same shape and the same orientation relative to the cutting device 300. This orientation includes angles 130 between the plane-defined-surface 32B and the cutter surface 38 of all three of the cutting elements 110A, 110B, 110C having the same angle. Additionally, in this embodiment the first element 110A is the same size as the second element 110B while the third element 110C is of a smaller size. This size relationship aids in creating the stable structure of the stack 114 resting on the cutter surface 38 due to gravity alone prior to the elements 110A, 110B, 110C being attached to each other and to the surface 38. Further adding to this stability is aligning the three elements 110A, 110B, 110C that define one of the stacks 114 such that all of their centroids 188, also known as the geometric centers, lie in a plane perpendicular to the surface 38. In this embodiment this plane is parallel to the plane of FIG. 1.

It should be noted that the stability of the stack relies on support of the third element 110C being supplied by each of the first element 110A and the second element 110B. Stated another way, without either of the first element 110A or the second element 110B the third element 110C would not be stably supported at the desired angle 130 prior to attachment.

The geometric configuration of the cutting elements 110A, 110B, 110C, specifically the central portion being and modified gilmoid 120 with at least one of the supports 124 extending from one of the plane-defined-surfaces 32A, 32B, aid in the attachment to each other and to the surface 38. This is due to gaps 192 defined between the elements 110A, 110B and the surface 38, and to gaps 196 defined between the elements 110A, 110B and the third element 110C. These gaps 192, 196 aid in attaching of the elements 110A, 110B to the surface 38 and the elements 110A, 110B to the element 110C through a brazing process. Specifically, the gaps 192, 196 encourage wicking and filling thereof with brazing material as well as whetting of the brazing material to the elements 110A, 110B, 110C. The stability of the stack 114 also aids in the brazing process by maintaining the elements 110A, 110B, 110C in the desired positional relationship to each other and the desired angular relationship to the surface 38 during the brazing process. In fact, the stability of the stack 114 permits an operator during a hand brazing process to inadvertently contact the elements 110A, 110B, 110C with the brazing torch or brazing material rod without the stack 114 toppling over or needed to be restacked to continue.

Figure 3:
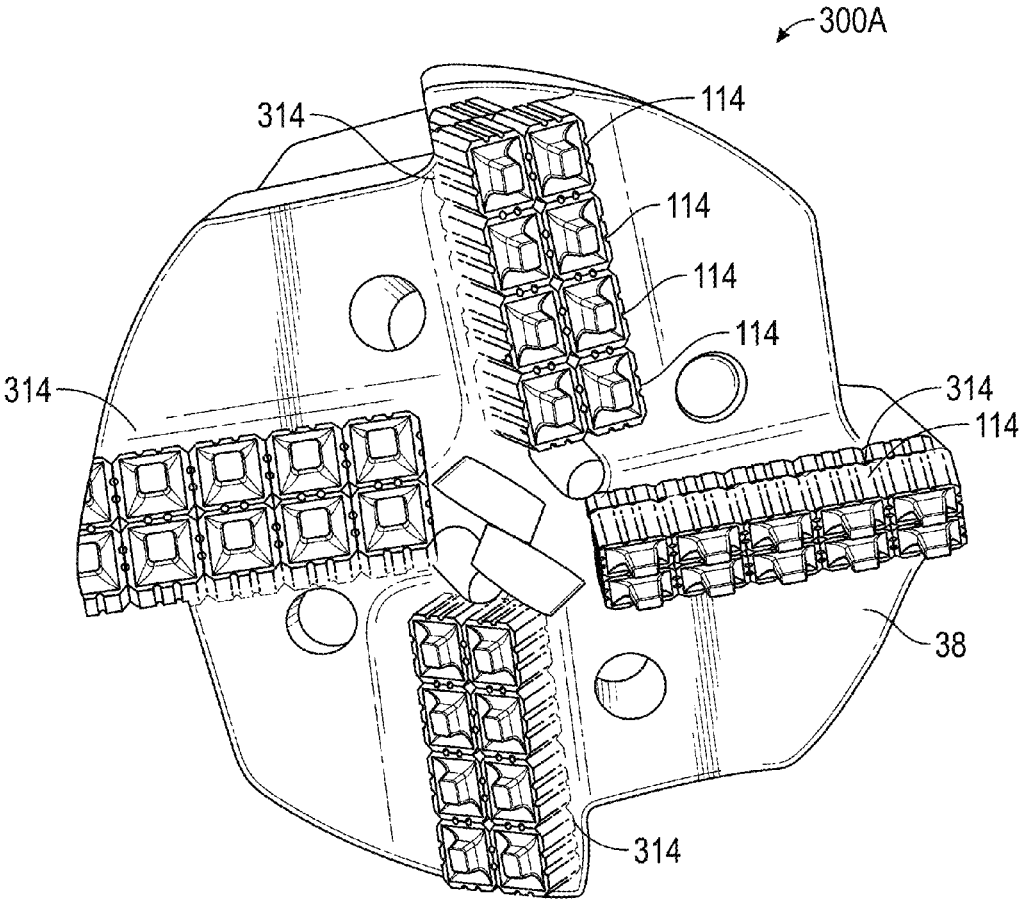
FIG. 3 depicts a perspective view of an alternate cutting device disclosed herein.
Figure 4:
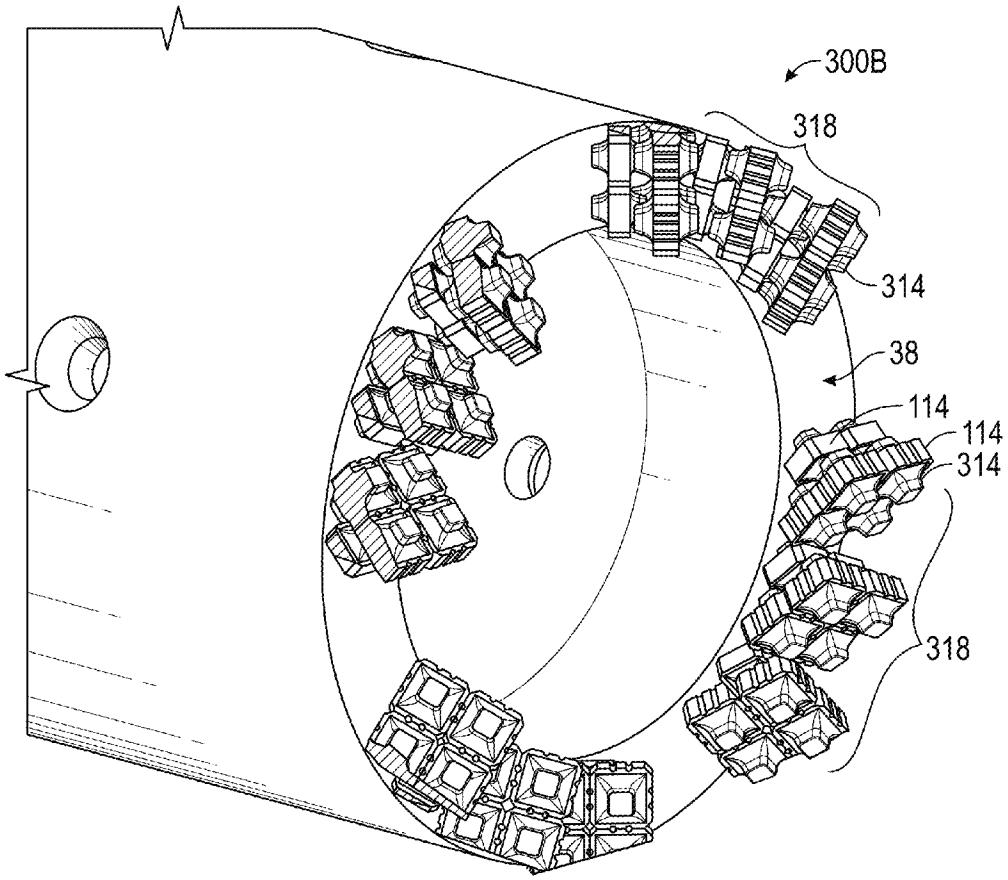
FIG. 4 depicts a perspective view of yet another alternate cutting device disclosed herein.

Referring to FIGS. 3 and 4, the stability of the stack 114 further facilitates positioning a plurality of the stacks 114 on the surface 38 prior to attachment thereto. Such positioning includes aligning one or more of the stacks 114 radially of another of the stacks 114 on the surface 38, thereby creating one or more blades 314. The cutting device 300A of FIG. 3 has four of the blades 314 positioned at substantially 90 degree to one another, while the cutting device 300B of FIG. 4 has many of the blades 314 distributed in clusters 318 on the surface 38. The cutting device 300B has a tubular shape thereby allowing it to cut in the manner of a hole saw.

The stacks 114 can be attached via brazing to the surface 38 one at a time or as a group, one such group being one or more of the blades 318 and another such group being one or more of the clusters 318. Brazing a plurality of the stacks 114 in a single operation can speed up the manufacturing process. Additionally, brazing the stacks 114 that are positioned adjacent to one another together, provides additional strength to the blades 314 and the clusters 318. The foregoing structure provides cutting devices 300A, 300B that have a repeating structure of the cutting element 110A, 110B, 110C, as opposed to a random configuration. The repeating structure provides more reliability and predictability in cutting rates and durability of the tool than those with randomly positioned and oriented cutting elements.

Another advantage of attaching the elements 110A, 110B, 110C to the surface 38 in the stacks 114 is that the devices 300, 300A, 300B continue to have sharp new cutting edges on the first element 110A and the second element 110B exposed for cutting after the third element 110C has been fractured and/or detached from the device 300, 300A, 300B.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of making a cutting device, comprising:

positioning a first element and a second element on a cutter surface;

stacking a third element onto the first element and the second element, the third element having a modified gilmoid with a support protruding from at least one of two plane-defined-surfaces that define the modified gilmoid, such that the one of two plane-defined-surfaces of the modified gilmoid further from the cutter surface forms an angle of between about 35 and 55 degrees with the cutter surface;

attaching the third element to the first element and the second element; and attaching the first element and the second element to the cutter surface, wherein the third element is spaced from the cutter surface by one of the first and second elements.

2. The method of making a cutting device of claim 1, further comprising orienting centroids of all three of the first element, the second element and the third element in a plane substantially perpendicular to the cutter surface during the stacking.

3. The method of making a cutting device of claim 1, further comprising forming a plurality of the three element stacks of claim 1 adjacent one another on the cutter surface prior to attaching the three elements to one another and the first element and the second element to the cutter surface.

4. The method of making a cutting device of claim 3, wherein the plurality of the three element stacks are attached to the cutter surface in a single operation.

5. The method of making a cutting device of claim 3, wherein the plurality of the three element stacks have substantially the same shape and size as one another.

6. The method of making a cutting device of claim 3, wherein the plurality of the three element stacks have substantially the same orientation as one another relative to the cutting device.

7. The method of making a cutting device of claim 1, wherein the attaching of the third element to the first element and the second element and the attaching of the first element and the second element to the cutter surface is by brazing.

8. The method of making a cutting device of claim 1, wherein a brazing material is whetted into gaps between the first element, the second element and the cutter surface during the attaching of the first element and the second element to the cutter surface.

9. The method of making a cutting device of claim 1, wherein a brazing material is whetted into gaps between the third element, the second element and the first element during the attaching of the third element to the first element and the second element.

10. The method of making a cutting device of claim 1, wherein angles between the cutter surface and at least one of two plane-defined-surfaces of modified gilmoids of each of the first element, the second element and the third element are substantially the same.

11. The method of making a cutting device of claim 1, wherein the stacking is via gravity alone.

12. The method of making a cutting device of claim 1, further comprising forming at least one radial blade on the cutter surface with a plurality of the three element stacks attached to the cutter surface.

13. The method of making a cutting device of claim 1, wherein at least one of the first element and the second element have a modified gilmoid with a support protruding from at least one of two plane-defined-surfaces that define the modified gilmoid.

14. A cutting device, comprising:

at least one stack of cutting elements attached to a cutter surface;

comprising:

a first element and a second element attached to the cutter surface; and a third element attached to the first element and the second element, the three elements being sized and shaped such that prior to attachment to the cutter surface the three elements are restable in a stable manner on the cutter surface due to gravity alone such that a plane-defined-surface defined by one of the two planes of a modified gilmoid of the third element positioned further from the cutter surface is oriented at an angle of about 35 to 55 degrees relative to the cutter surface, wherein the third element is spaced from the cutter surface by one of the first and second cutting elements.

15. The cutting device of claim 14, wherein the attachments are brazed.

16. The cutting device of claim 14, wherein a position and orientation of the third element above the first element and the second element is stable prior to attaching the first element, the second element and the third element together.

17. The cutting device of claim 16, wherein stability of the third element above the first element and the second element relies on contact of the third element with both the first element and the second element.

18. The cutting device of claim 14, wherein stability of the third element above the first element and the second element requires the plane-defined-surface of the modified gilmoid of the third element be oriented at an angle of between about 35 to 55 degrees relative to the cutter surface.

19. The cutting device of claim 14, wherein the first element, the second element and the third element have substantially the same shape.

20. The cutting device of claim 14, wherein the first element and the third element are substantially the same size as one another while the second element is smaller than the first element and the third element.

21. The cutting device of claim 14, wherein the cutter surface is on an end of a cylindrical body.

22. The cutting device of claim 14, wherein the cutting device has a hole saw structure.

23. The cutting device of claim 14, wherein the first element and the second element are positioned and configured to serve as cutting elements when the third element has become detached therefrom.

24. The cutting device of claim 14, wherein the three elements have substantially the same shape.

25. The cutting device of claim 14, wherein a plane-defined-surface of a modified gilmoid of at least one of the first element and the second element that is positioned further from the cutter surface is oriented at an angle of about 35 to 55 degrees relative to the cutter surface.

26. The cutting device of claim 14, wherein centroids of the first element, the second element and the third element lie substantially in a plane perpendicular to the cutter surface.

27. The cutting device of claim 14, wherein the cutting device includes a plurality of the at least one stacks.

28. The cutting device of claim 14, wherein a plurality of the at least one stacks are positioned radially to one another on the cutter surface.

29. The cutting device of claim 14, wherein cutting elements of one stack are attached to cutting elements of another stack.

* * * * *